US006942206B2

(12) United States Patent
Kuwata et al.

(10) Patent No.: US 6,942,206 B2
(45) Date of Patent: Sep. 13, 2005

(54) SHEET TREATING APPARATUS AND IMAGE FORMING APPARATUS HAVING THE SAME

(75) Inventors: Takashi Kuwata, Shizuoka (JP); Yasuyoshi Hayakawa, Shizuoka (JP); Kenichiro Isobe, Shizuoka (JP); Masayoshi Fukatsu, Shizuoka (JP); Junichi Sekiyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/227,482

(22) Filed: Aug. 26, 2002

(65) Prior Publication Data

US 2003/0057625 A1 Mar. 27, 2003

(30) Foreign Application Priority Data

Aug. 31, 2001 (JP) ..... 2001-265113
Aug. 31, 2001 (JP) ..... 2001-265114

(51) Int. Cl.[7] ..... B65H 37/04

(52) U.S. Cl. ..... 270/58.08; 270/58.11; 270/58.18; 270/58.14; 399/410; 399/405; 271/207; 271/213

(58) Field of Search ..... 270/58.07, 58.08, 270/58.11, 58.12, 58.13, 58.14, 58.15, 58.16, 58.18; 399/405, 407, 408, 410; 414/793.4; 271/207, 213, 221, 222

(56) References Cited

U.S. PATENT DOCUMENTS 5,137,265 A * 8/1992 Sato et al. ..... 270/58.12
5,201,517 A * 4/1993 Stemmle ..... 271/291
5,288,062 A 2/1994 Rizzolo et al. ..... 270/53
5,346,203 A * 9/1994 Stemmle ..... 271/288
5,649,695 A * 7/1997 Lawrence ..... 270/58.12
5,921,690 A * 7/1999 Shinmachi et al. ..... 400/625
5,971,384 A * 10/1999 Asao ..... 270/58.13
6,098,975 A 8/2000 Kobayashi ..... 270/58.09
6,120,020 A 9/2000 Asao ..... 271/189
6,142,461 A 11/2000 Asao et al. ..... 270/58.09
6,231,039 B1 * 5/2001 Chung ..... 270/58.01
6,286,830 B1 9/2001 Kitahara et al. ..... 271/223
6,330,999 B2 * 12/2001 Coombs et al. ..... 270/58.18
6,352,253 B1 3/2002 Hayakawa et al. ..... 270/58.12
6,382,615 B1 * 5/2002 Ishiguro et al. ..... 270/58.12
6,408,147 B1 * 6/2002 Oshida ..... 399/82
6,450,934 B1 * 9/2002 Coombs ..... 493/383
6,550,763 B2 * 4/2003 Gordon et al. ..... 271/189
6,581,922 B2 * 6/2003 Kuwata et al. ..... 270/58.11

FOREIGN PATENT DOCUMENTS

| | | |
|---|---|---|
| EP | 0 371 403 | 6/1990 |
| EP | 1 168 091 A1 | 1/2002 |
| JP | 8-225227 | 9/1996 |
| JP | 2000-86074 | 3/2000 |
| JP | 2001-106423 | 4/2001 |

OTHER PUBLICATIONS

*Patent Abstracts of Japan, Publication No. 2001–106423, Apr. 17, 2001.

* cited by examiner

*Primary Examiner*—Patrick Mackey
(74) *Attorney, Agent, or Firm*—Fitzpatrick, Cella, Harper & Scinto

(57) ABSTRACT

An aligning device movable to a first position constituting a first sheet stacking portion for supporting a delivered sheet and a second position in which the sheet is not supported is provided downstream of a pair of delivery rollers, and the pair of delivery rollers are designed to be capable of assuming a first state in which they are capable of delivering the sheet, and a second state in which rollers constituting the pair of delivery rollers are spaced apart from each other. When the pair of delivery rollers are in the first state and the aligning device is in the first position, a sheet aligning and stacking portion for making the alignment of the sheet by the aligning device possible is defined by the first stacking portion and the sheet transport path between a reference wall and the pair of delivery rollers.

15 Claims, 14 Drawing Sheets

SHEET TREATING APPARATUS AND IMAGE FORMING APPARATUS HAVING THE SAME

BACKGROUND OF THE INVENTION

1. Field of the Invention

The invention relates to a sheet treating apparatus of which the installation area and cost can be reduced and an image forming apparatus having the same. Particularly the invention relates to a construction for delivering sheets to a sheet stacking portion. The invention also relates to the sheet aligning operation performed when a sheet is treated.

2. Related Background Art

Some image forming apparatuses such as copying machines, printers and facsimile apparatuses have a sheet treating apparatus adapted to successively introduce sheets after images have been formed thereon into the apparatus, and effect the stitching treatment on these sheets, in order to mitigate the time and labor required for the stitching treatment, for example, for sheets such as copy paper after images have been formed thereon.

As such a sheet treating apparatus, there is known one a type which is provided on a side of the sheet delivery port of the main body of an image forming apparatus, and successively aligns sheets supplied from the delivery port after being on the main body side of the image forming apparatus, and thereafter effects the stitching treatment on these sheets and delivers them.

Now, in such a conventional image forming apparatus, for example, in order to enable sheets subjected to image formation (printing) on the main body side of the image forming apparatus to be stitched in the order of pages, a switchback mechanism for inverting the sheets to the sheet treating apparatus side is provided so as to deliver and stack the sheets in the order of pages.

However, when the switchback mechanism is thus provided, there has been the inconvenience that the spacing between the sheets must be widened for switchback. Also, the sheet treating apparatus is provided on a side of the sheet delivery port of the main body of the image forming apparatus, and this also has led to the inconvenience that not only the installation area of the entire apparatus is increased, but also the cost thereof becomes high.

Also, some of staple stackers serving both to stack sheets not subjected to treatment and to stack sheets subjected to treatment such as stapling have two sheet transport paths, and when the two sheet transport paths are thus provided, there has been the inconvenience that not only the apparatus becomes bulky, but also the cost thereof becomes high.

Also, in such a conventional sheet treating apparatus, it is necessary, for example, to align sheets before effecting the stitching treatment on the sheets subjected to image formation (printing) on the main body side of the image forming apparatus and therefore, provision is made of a dedicated aligning and stacking portion for stacking the aligned sheets thereon. However, when the dedicated aligning and stacking portion is thus provided, there has been the inconvenience that not only the apparatus becomes bulky, but also the cost thereof becomes high.

SUMMARY OF THE INVENTION

So, the present invention has been made in view of such circumstances and has as its object to provide a sheet treating apparatus of which the installation area and cost can be reduced and an image forming apparatus having the same.

The present invention is a sheet treating apparatus for effecting treatment on a sheet having an image formed thereon, provided with a pair of delivery rollers for delivering the sheet, aligning means provided downstream of the pair of delivery rollers in opposed relationship with each other and movable between a first position constituting a first sheet stacking portion for supporting the sheet delivered from the pair of delivery rollers and a second position in which they do not support the sheet, and for abutting against a side of the sheet in the cross direction of the sheet and regulating the sheet, and a second sheet stacking portion located substantially vertically downwardly of the aligning means for supporting the sheet delivered from the pair of delivery rollers or a sheet subjected to treatment, and thereafter downwardly delivered with the movement of the aligning means to the second position, wherein the pair of delivery rollers can assume a first state in which the pair of delivery rollers can deliver the sheet and a second state in which rollers constituting the pair of delivery rollers are spaced apart from each other, and when the pair of delivery rollers are in the first state and the aligning means are in the second position, the sheet is directly stacked on the second sheet stacking portion, and when the pair of delivery rollers are in the second state and the aligning means are in the first position, the aligning means become capable of aligning the sheet.

Also, in the present invention, the aligning means is moved to the second position and the pair of delivery rollers assume the first state after the treatment for the sheet has been terminated, whereby the treated sheet is delivered to the second sheet stacking portion.

Also, in the present invention, the second sheet stacking portion may be provided on the upper surface of the main body of the apparatus.

Also, the present invention may be provided with sheet returning means for effecting the alignment of sheets stacked on the first sheet stacking portion in the delivery direction of the sheets, and a wall member for aligning the trailing ends of the sheets returned by the sheet returning means or with the aid of gravity.

Also, in the present invention, the pair of delivery rollers, when in the second state, may have its drive disconnected.

Also, in the present invention, the aligning means may have a plurality of convex portions for abutting against a side of the sheet to thereby align the sheet with a predetermined position.

Also, in the present invention, the convex portions may be formed of a material high in abrasion resistance.

Also, the present invention may be provided with a stapler for stitching the predetermined positions of the sheets stacked on the first sheet stacking portion.

Also, in the present invention, the treatment to be effected on the sheet may be the aligning operation for the sheets stacked on the first sheet stacking portion.

Also, the present invention may be provided with sheet returning means for aligning the sheets stacked on the first sheet stacking portion in the sheet delivery direction, and a wall member for aligning the trailing ends of the sheets returned by the sheet returning means or with the aid of gravity, and the sheet aligning and stacking portion may be formed by the sheet transport path between the wall member and the pair of delivery rollers, and the first sheet stacking portion.

Also, in the present invention, the aligning means may have a supporting portion for supporting the sheet delivered from the pair of delivery rollers and constituting the first sheet stacking portion, and an abutting surface provided on the end portion of the supporting portion, and abutting against the side of the sheet in the cross direction of the sheet.

Also, in the present invention, the first sheet stacking portion may be formed when the spacing between the supporting portions of the aligning means provided in opposed relationship with each other becomes narrower than the width of the sheet delivered from the pair of delivery rollers, and the second position may be a position in which the spacing between the supporting portions becomes wider than the width of the sheet.

Also, in the present invention, the aligning means may be moved to the second position and the pair of delivery rollers assume the first state after the treatment for the aligned sheet has been terminated, whereby the treated sheet may be delivered to the second sheet stacking portion.

Also, the present invention may be any one of the above-described sheet treating apparatus in an image forming apparatus having an image forming portion and a sheet treating apparatus for treating a sheet on which an image has been formed by the image forming portion.

As described above, according to the present invention, design is made such that when a sheet is to be treated, the sheet delivered from the pair of delivery rollers is supported by the aligning means, whereafter the sheet after treated is delivered to the second sheet stacking portion, and on the other hand, when the treatment for the sheet is not effected, the sheet delivered from the pair of delivery rollers is directly delivered to the second sheet stacking portion without being supported by the aligning means and therefore, it is not necessary to discretely provide a transport path for sheets on which treatment for sheets is not effected, and design is made such that when the pair of delivery rollers for delivering the sheet assume the second state in which the rollers constituting the pair of delivery rollers are spaced apart from each other, there is formed the sheet aligning and stacking portion which makes the alignment of the sheet by the aligning means possible, whereby without providing a dedicated sheet aligning and stacking portion, the sheet can be aligned, whereby the downsizing of the apparatus and a reduction in the cost thereof become possible.

DESCRIPTION OF THE PREFERRED EMBODIMENTS

Some embodiments of the present invention will hereinafter be described in detail with reference to the drawings.

Figure 1:
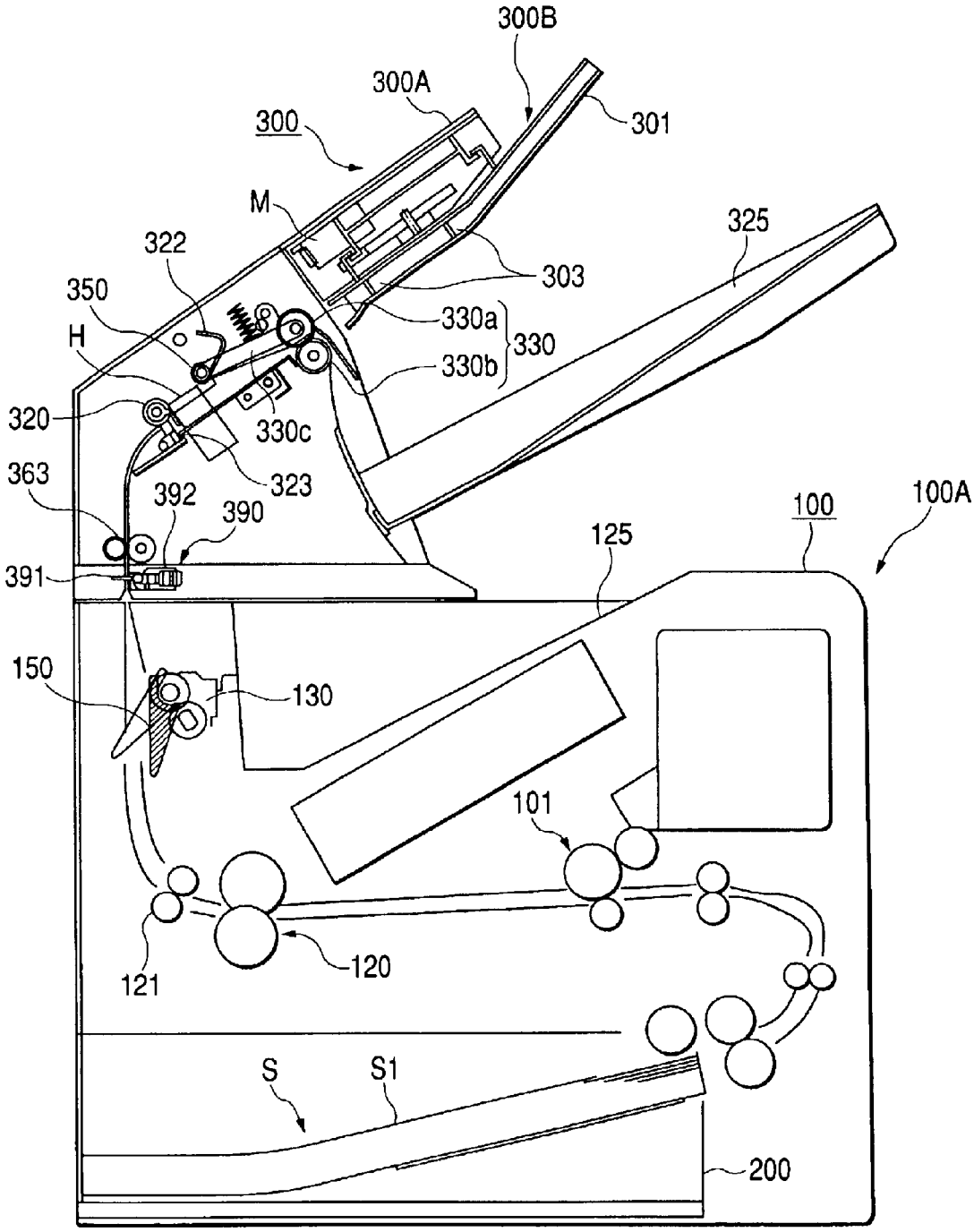
FIG. 1 is a schematic cross-sectional view showing the general construction of a laser beam printer which is an example of an image forming apparatus having a sheet treating apparatus according to a first embodiment of the present invention.

FIG. 1 is a schematic cross-sectional view showing the general construction of a laser beam printer which is an example of an image forming apparatus having a sheet treating apparatus according to a first embodiment of the present invention.

In FIG. 1, the reference character 100A designates the laser beam printer, and the reference numeral 100 denotes the main body of the laser beam printer (hereinafter referred to as the main body of the printer), and this laser beam printer 100A is independently connected to a computer or the network of LAN or the like, and is adapted to effect image formation (print) on a sheet by a predetermined image forming process on the basis of image information, a printing signal or the like sent from the computer or the network, and deliver the sheet.

Also, the reference numeral 300 designates the sheet treating apparatus, and this sheet treating apparatus 300 is disposed above the main body 100 of the printer and is adapted to place the sheet delivered out of the main body 100 of the printer on a first (sheet) stacking portion 300B in a face-down state in which the image bearing surface of the sheet faces downward, via a transporting portion in the sheet treating apparatus, and thereafter effect alignment by aligning means 301 which will be described later, and bundle sheets in each predetermined job and staple the sheets at one or more portions thereof and deliver and stack the sheets to and on a second stacking portion 325, or simply deliver and stack the sheets to and on the second stacking portion 325 in a face-down state.

The sheet treating apparatus 300 and the main body 100 of the printer are electrically connected together by a cable connector (not shown). Also, the sheet treating apparatus 300 has a casing portion 300A containing various portions therein, and is detachably attachable to the main body 100 of the printer.

The construction of each portion of the main body 100 of the printer will now be described along the transport path of the sheet S transported.

In the main body 100 of the printer, a plurality of sheets S are stacked in a feed cassette 200, and design is made such that the sheets S are separated and fed one by one from the uppermost sheet S1 by various rollers. By a predetermined printing signal supplied from the computer or the network, the sheet S fed from the feed cassette 200 has first transferred to its upper surface a toner image in an image forming portion 101 for forming a toner image by an image forming process of the so-called laser beam type, and subsequently has heat and pressure applied thereto by a fixing device 120 on the downstream side, whereby this toner image is permanently fixed.

Next, the sheet S on which the image has been fixed is turned back on a substantially U-shaped sheet transport path to delivery rollers 130, whereby the image bearing surface thereof is inverted, with the image bearing surface thus facing downward, the sheet S is delivered out of the main body 100 of the printer.

Here, design is made such that this sheet S is delivered to a face-down (FD) delivery portion 125 provided in the upper portion of the main body 100 of the printer, or to the second (sheet) stacking portion 325 of the sheet treating apparatus 300, for example, by the delivery rollers 130 in conformity with the position of the flapper 150 of the main body 100 of the printer which is pivotally moved on the basis of a control signal from a control portion (not shown).

Reference is now had to FIGS. 2A, 2B, 3A and 3B to describe the construction of the sheet treating apparatus 300 and the movement of each portion when the sheet S transported from the main body 100 of the printer goes toward the sheet treating apparatus 300.

Figure 2A:
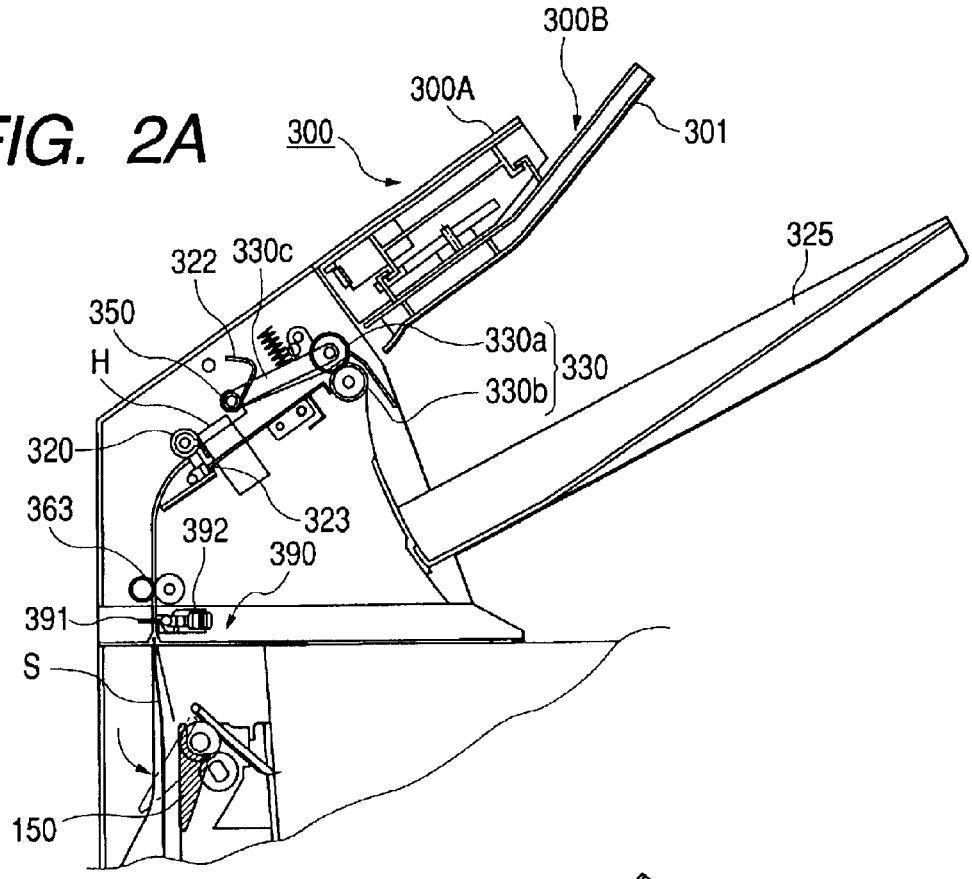
FIGS. 2A and 2B illustrate the construction of the sheet treating apparatus and the movement of each portion when a sheet transported from the main body of the printer goes toward the sheet treating apparatus.
Figure 2B:
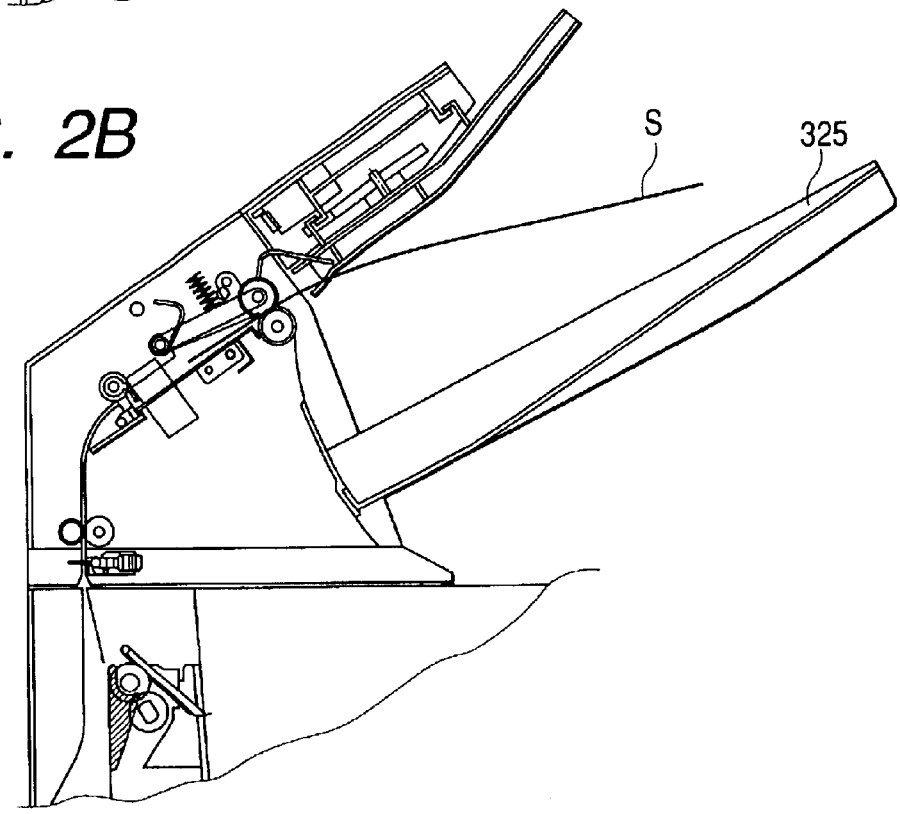

In FIGS. 2A and 2B, the reference character 330*a* designates an upper delivery roller, the reference character 330*b* denotes a lower delivery roller, the letter M designates a jogger motor as a drive source, the reference numeral 322 denotes a paddle, and the reference numeral 323 designates a reference wall, against which the trailing edge of the sheet hits. A pair of delivery rollers 330 constituted by the upper delivery roller 330*a* and the lower delivery roller 330*b*, as shown in FIG. 2A, are disposed upwardly downstream of the above-mentioned flapper 150 in the sheet transport direction, and are rotatively driven by a driving motor (not shown).

Also, the upper delivery roller 330*a* is supported on an arm 330*c* pivotally movable about a paddle shaft 350. The jogger motor M is a motor for driving slide guides 301 and 302 which will be described later, and in the present embodiment, a stepping motor is used as the jogger motor M.

Also, the paddle 322 which is sheet returning means is formed of a flexible material such as rubber, and a plurality of such paddles are fixed to the paddle shaft 350 in a direction orthogonal to the sheet transport direction. When the sheet is delivered from the main body 100 of the printer, the paddles 322 are adapted to be clockwisely rotated by the driving of the paddle shaft 350, whereby the sheet S is moved in a direction opposite to the sheet transport direction and abuts against the reference wall 323 which is a wall member, and is aligned thereby.

Figure 3A:
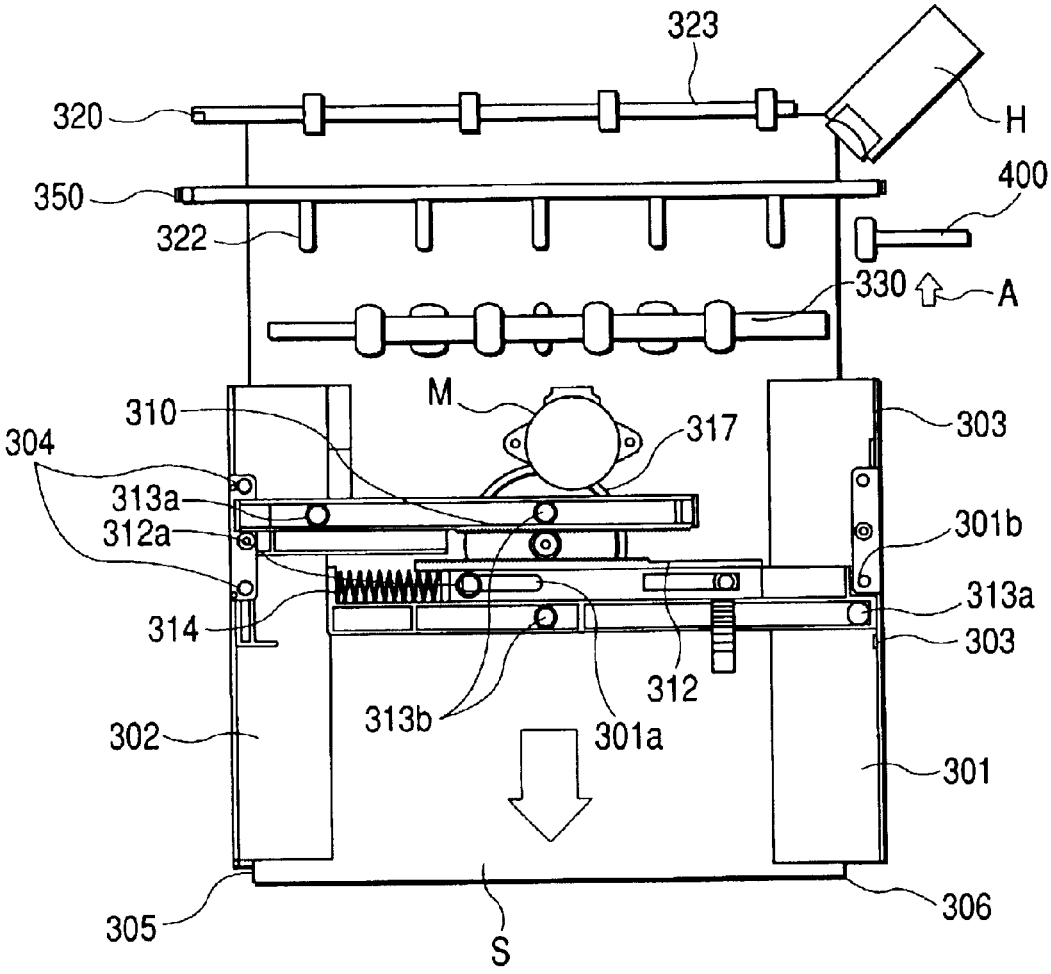
FIGS. 3A and 3B are a plan view and a side view, respectively, of the essential portions of the sheet treating apparatus.
Figure 3B:
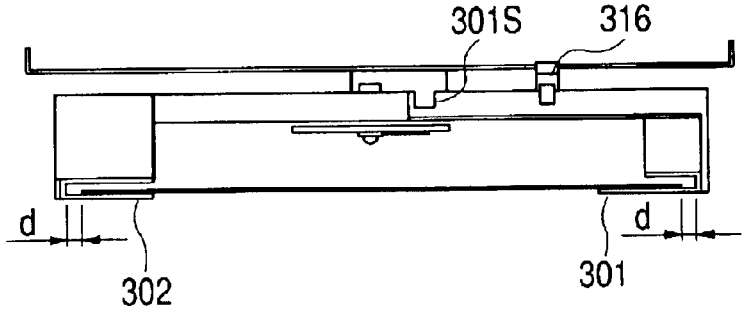

Also, as shown in FIGS. 3A and 3B, in the sheet treating apparatus 300 of the present embodiment, the slide guide 301 and the slide guide 302 which will be described later in detail are provided as aligning members for effecting the alignment of the sheet in the cross direction of the sheet. Also, in FIG. 3A, the letter H denotes a stapler which is stitching means for effecting the stitching treatment on the stacked sheet by stapling the stacked sheet, and this stapler H is fixedly disposed on the slide guide 301 side to effect stapling on the left upper corner portions of the image bearing surfaces of the sheets on which images have been formed to thereby stitch the sheets.

The sheet treating apparatus 300 of such a construction is adapted to effect the stapling treatment on the basis of a command outputted in advance from the computer or the like, and when such stapling treatment is to be effected, before the sheet S to be stapled is delivered by transport rollers 121 (see FIG. 1) provided in the main body 100 of the printer, the flapper 150 is counter-clockwisely pivotally moved, as shown in FIG. 2A, by a solenoid (not shown) to thereby change over the paper path to the sheet treating apparatus side.

Thus, the sheet S is transported into the sheet treating apparatus 300 by the transport rollers 121. The sheet S thus transported into the sheet treating apparatus 300 clockwisely rotates the flag 391 of an entrance sensor 390, whereby the flag 391 makes a photosensor 392 transmit light, whereby the sheet S is detected. Thereafter, the sheet S is upwardly transported by a pair of entrance rollers 363.

Now, in the present embodiment, this sheet treating apparatus 300 is designed to be capable of stapling the sheets and delivering and stacking them on the second stacking portion 325 and simply delivering and stacking the sheets in the face-down state on the second stacking portion 325.

Description will now be made of the operation of delivering and stacking the sheets in the face-down state on the second stacking portion 325.

Figure 4A:
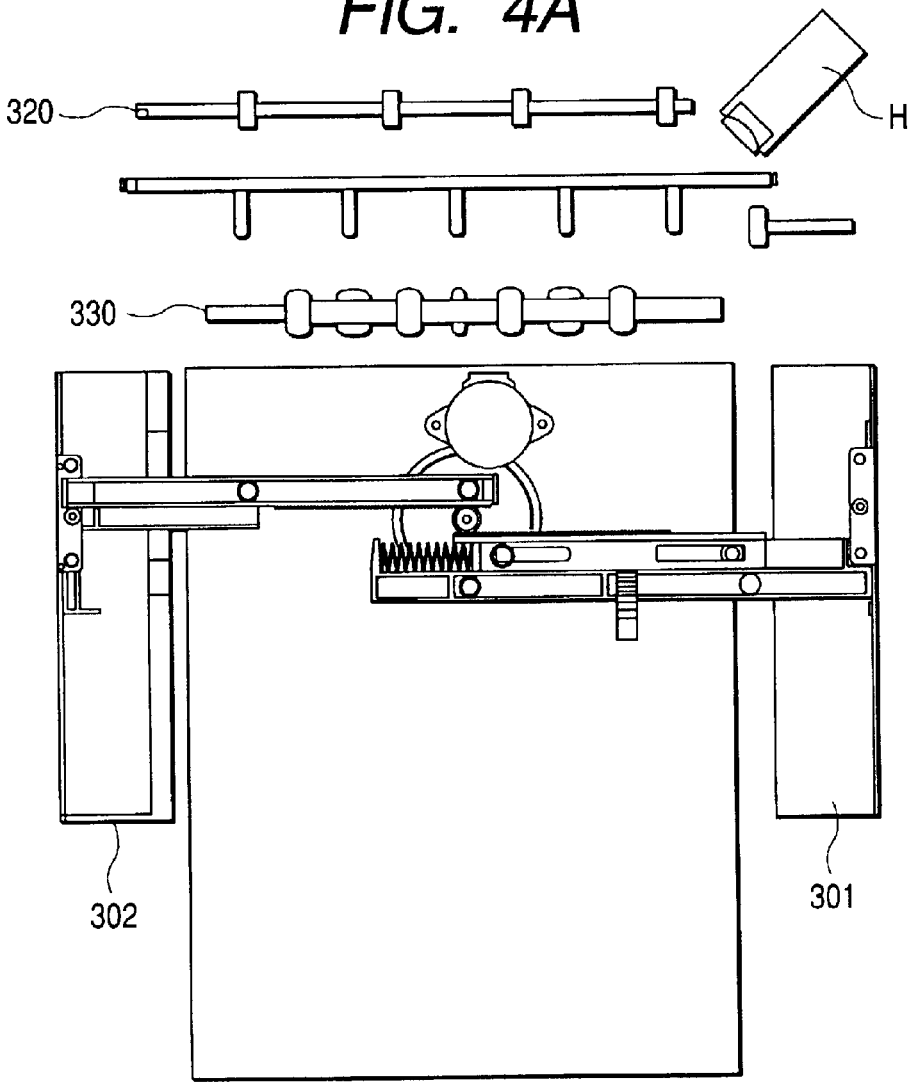
FIGS. 4A and 4B show a state in which a slide guide provided in the sheet treating apparatus is located at a home position and a sheet bundle falls.

In this case, as shown in FIG. 4A, the bottom surface constituting the supporting portions of the right slide guide 301 and the left slide guide 302 with respect to the sheet transport direction which support the sheet is retracted to a position in which the bottom surface does not contact with the sheet S transported thereto, that is, a position (second position) a predetermined amount outside the cross direction of the sheet in which the bottom surface does not support the sheet.

Figure 4B:
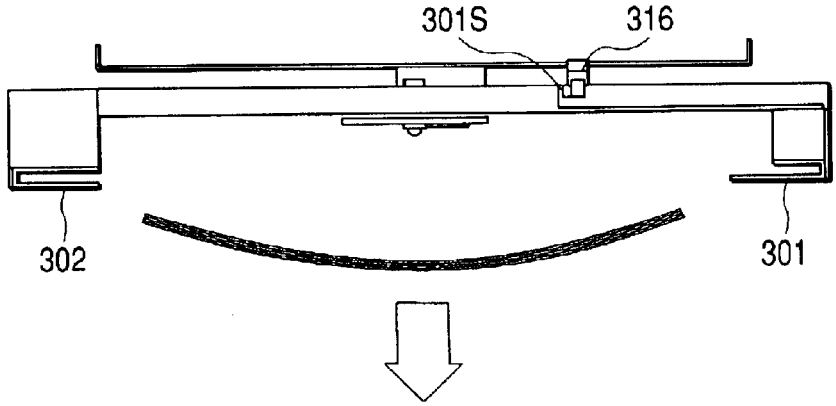

Accordingly, the sheet transported by the pair of entrance rollers 363 passes a pair of staple rollers 320, and thereafter passes through the frontage of the stapler H, and then is transported by the pair of delivery rollers 330, and falls toward a second sheet delivery portion 325, as shown by the arrow in FIG. 4B and in FIG. 2B.

Description will now be made of the operation of stapling the sheets and delivering and stacking them on the second stacking portion 325.

In this case, the slide guides 301 and 302 are such that as shown in FIG. 3A, reference pins 303 and 304 constituting convex portions provided on the wall surfaces of the slide guides 301 and 302 for aligning the sheet are retracted to a position in which they do not interfere with the sheet S transported thereto.

Also, at this time, the spacing between the end surfaces of the bottom surfaces of the two slide guides 301 and 302 is at a position smaller than the width of the sheet S, and by the two slide guides 301 and 302 being at such a position (first position), it becomes possible to constitute a first stacking portion 300B for supporting the sheet S coming in.

Accordingly, the sheet transported by the pair of entrance rollers 363 passes the pair of staple rollers 320, and thereafter passes through the frontage of the stapler H, and then is transported by the pair of delivery rollers 330, and is transported onto the guide surface of a first sheet stacking portion 300B constituted by the slide guides 301 and 302.

Figure 5A:
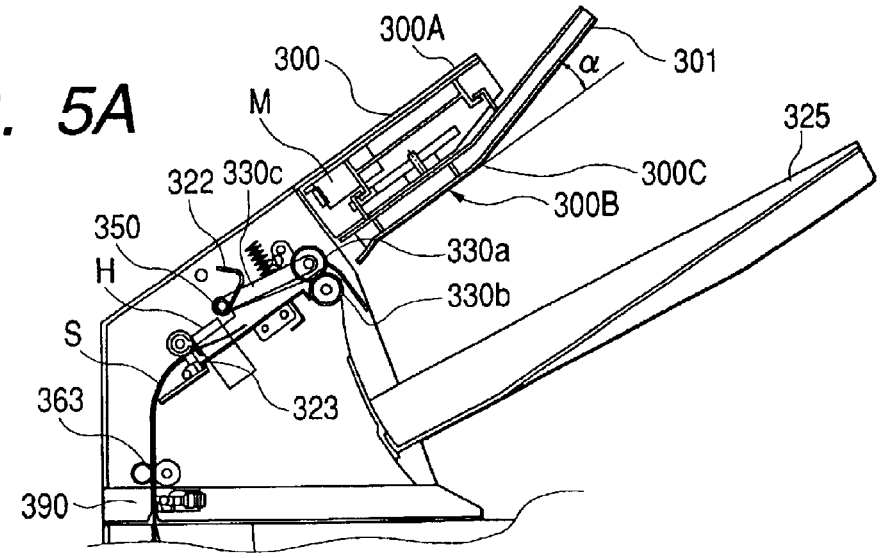
FIGS. 5A, 5B and 5C illustrate the movement of each portion in the stitching operation of the sheet treating apparatus.

The guide surface of the first sheet stacking portion 300B constituted by the sheet supporting portions of the two slide guides 301 and 302, as shown in FIG. 5A, is inclined at a predetermined angle with respect to the horizontal direction and has different angles of inclination on the upstream side and the downstream side in the sheet transport direction, and specifically a bent portion 300C bent at an angle of inclination $\alpha$ is formed between a predetermined section on the upstream side and a predetermined section on the downstream side. By having such a bent portion 300C, the flexure of the central portion of the sheet S which is not guided by the slide guides 301 and 302 is prevented.

Figure 5B:
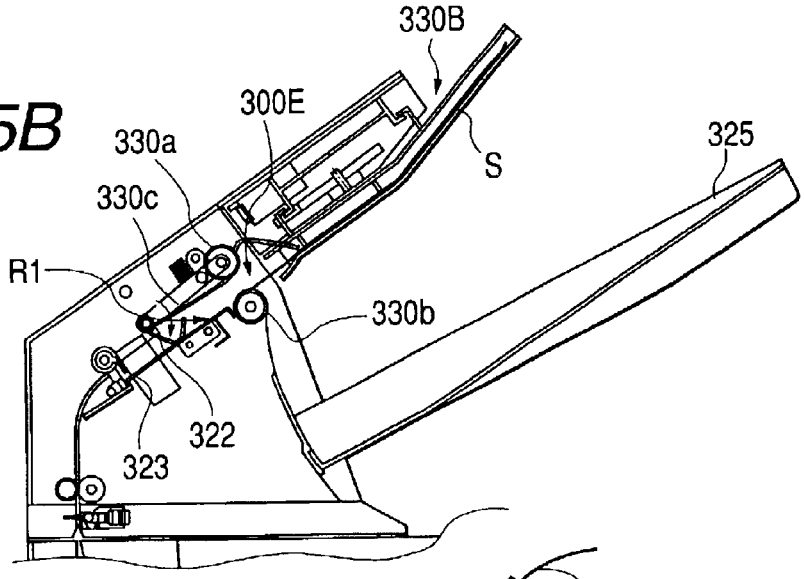

On the other hand, immediately after the first sheet has been thus transported onto the surface formed by the slide guides 301 and 302, the arm 330*c* is counter-clockwisely pivotally moved as shown in FIG. 5B, whereby the upper delivery roller 330*a* supported on the arm 330*c* is upwardly retracted, and the pair of delivery rollers are spaced apart from each other.

Also, at the same time, the drive connected to the pair of delivery rollers 330 is cut off to thereby stop the rotation of the upper delivery roller 330*a* and the lower delivery roller 330*b*. When as the result, the trailing end of the sheet S completely passes between the pair of staple rollers 320, the sheet S is returned in a direction opposite to the transport direction with the aid of gravity and is moved toward the reference wall 323.

By the pair of delivery rollers 330 being thus spaced apart from each other and the rotation of the lower delivery roller 330*b* being stopped, there are formed the first stacking portion 300B constituted by the slide guides 301 and 302, and a sheet aligning and stacking portion 300E for aligning the sheet S by the reference wall 323 (the pair of staple rollers 320) and the sheet transport path R1 between the reference wall 323 and the pair of delivery rollers 330.

Next, only the left slide guide 302 is operated and the aligning operation for the sheets S stacked on the first sheet stacking portion 300B in the cross direction of the sheet is started. Specifically, the slide guide 302 is driven by the motor M and is moved to the right as viewed in FIG. 3A, whereby the reference pin 304 provided on the slide guide 302 abuts against the left side of the sheet S to thereby push the sheet S to the slide guide 301 side.

The right side of the sheet S then hits against the reference pin 303 provided on the slide guide 301, whereby the alignment of the sheet in the cross direction of the sheet is effected. The sheet S is set so as to be moved to a staple position set at a position whereat the sheet abuts against the reference pin 303 and is aligned thereby. After the aligning operation, the slide guide 302 is moved in a direction widening more than the width of the sheet S so that again at a standby position, it can cope with the transport of the next sheet.

The construction of the slide guides 301 and 302 will be described in detail here.

The slide guides 301 and 302, as shown in FIG. 3A, are guided by four guide pins in total, i.e., guide pins 313*a* provided on a mold frame F and guide pins 313*b* provided on a metal plate frame F, whereby they are made reciprocally movable to right and left as viewed in FIG. 3A, i.e., a direction (cross direction) perpendicular to the sheet transport direction and also, are adapted to be moved by a driving force from the jogger motor M.

Also, each of the slide guides 301 and 302, when seen from the downstream side in the sheet transport direction, presents a substantially U-shaped cross section by each wall portion for guiding the both sides of the sheet S and a supporting portion for supporting the upper and lower surfaces of the sheet S, as shown in FIG. 3B, and each sheet delivered onto the first sheet stacking portion 300B is supported by this U-shaped lower surface, and design is made such that they do not guide the cross direction central portion of the sheet S.

Further, the slide guide 302 is provided with a slide rack portion 310 having a spur gear meshing with a stepped gear 317. Also, the slide guide 301 has mounted thereon a slide rack 312 having a spur gear meshing with the stepped gear 317.

The slide rack 312 is provided for movement relative to the slide guide 301 through a coil-shaped spring 314. This spring 314 has its one end abutting against the slide guide 302 and has its other end abutting against the slide rack 312, and biases the slide guide 301 and the slide rack 312 in a direction to widen the spacing therebetween. Also, the slide rack 312 has a rectangular aperture portion 312*a* for moving an embossed portion 301*a* on the slide guide 301 side.

Further, two reference pins 303 formed of a metal excellent in abrasion resistance are provided on a side wall of the slide guide 301, and two reference pins 304 are provided on a side wall of the slide guide 302, and when the sheet is to be aligned, as previously described, the slide guide 302 is moved and the reference pins 304 and 303 abut against the opposite end surfaces 305 and 306 of the sheet.

Also, the slide guide 301 and the slide guide 302 have their height directions supported by the stepped gear 317 and the jog metal plate frame F.

The operation of the slide guides 301 and 302 will now be described.

When the power source of the sheet treating apparatus 300 is turned on, the pair of staple rollers 320 starts to be rotated, and then the jogger motor M is rotated and the stepped gear 317 is rotated, whereby the slide rack portion 310 of the slide guide 302 is driven and is outwardly retracted.

Also, as regards the slide guide 301, when the jogger motor M is rotated and the stepped gear 317 is rotated, the slide rack 312 is first relatively moved and the rectangular aperture portion 312*a* of the slide rack 312 abuts against the right end surface of the embossed portion 301*a* of the slide guide 301 as viewed in FIG. 3A, and thereafter the slide guide 301 is pushed by the rectangular aperture portion 312*a* and is outwardly retracted thereby.

The slide guide 301 is provided with a slit portion 301S, and when the slit portion 301S is moved to a predetermined retracted distance, as shown in FIG. 4B, a photosensor 316 transmits light therethrough and at that point of time, the jogger motor M is stopped. Hereinafter, this position will be referred to as the home position.

On the other hand, when a signal indicative of the sheet S coming into the sheet treating apparatus 300 is inputted from the main body 100 of the printer, the jogger motor M is rotated and the slide guides 301 and 302 are inwardly moved, and as shown in FIG. 3B, they are stopped at a position wider by a predetermined amount d than the width of the sheet S coming in. At this position, the slide guide 301 has its stopper 301*b* abutting against a guide pin 313*a* and becomes incapable of being inwardly moved any further. Hereinafter, this position will be referred to as the standby position. At this standby position, a side of the slide guide 301 becomes the reference position during the aligning operation.

In the present embodiment, the standby positions of the slide guides 301 and 302 are set so that when the size (width) of the sheet S is a suppliable maximum size, the gaps on the opposite sides may be the predetermined amount d.

When a sheet having a width narrower than this is to be aligned, the slide guide 302 is rightwardly moved by an amount corresponding to it, whereby the left gap at the standby position shown in FIG. 3B always becomes the predetermined amount d. On the other hand, in this case, the gap between the sheet and the slide guide 302 widens by a half of the amount which has become narrower than the predetermined amount d.

Figure 6A:
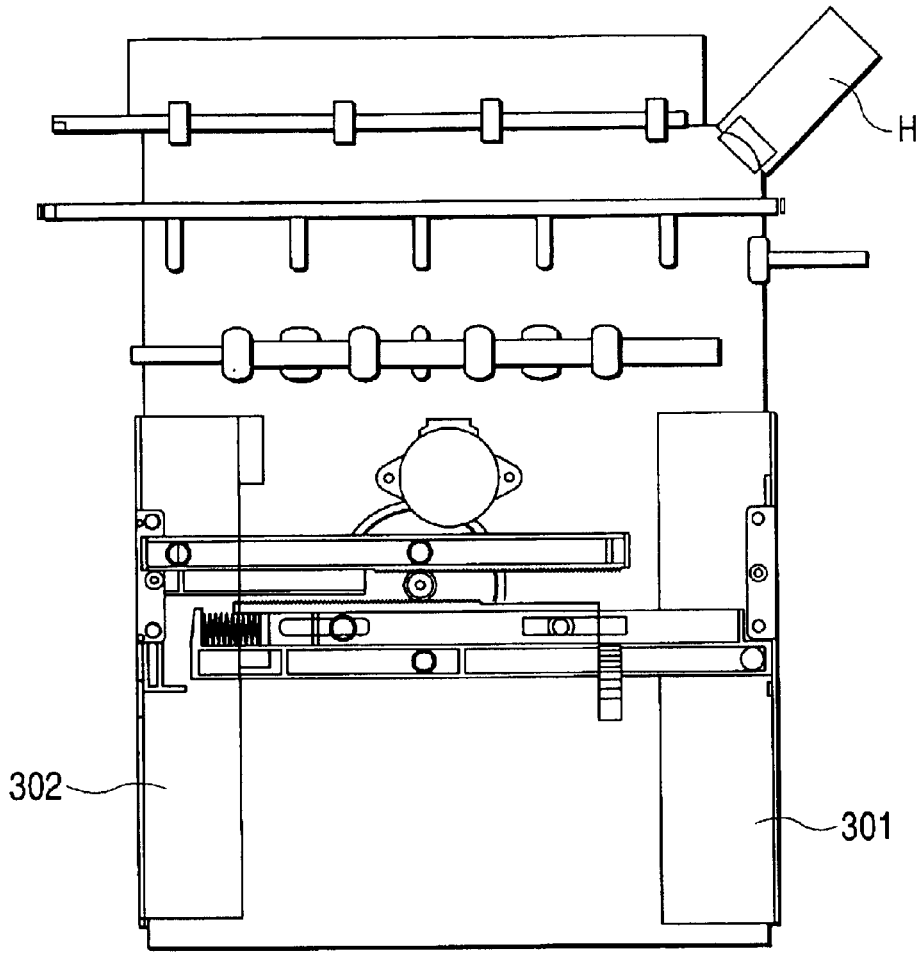
FIGS. 6A and 6B show a state in which a sheet is aligned by the slide guide.
Figure 6B:
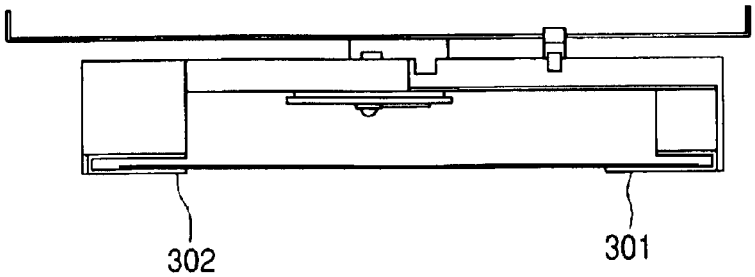

On the other hand, as shown in FIGS. 6A and 6B, widthwise alignment is effected by the slide guides 301 and 302, whereafter the two slide guides 301 and 302 are somewhat outwardly retracted to thereby make the regulation of the sheet S in the aligning direction thereof rough and render the sheet S movable in the sheet transport direction. Thereafter, as shown in FIG. 5B, the paddle 322 rotates through one revolution clockwise about the paddle shaft 350 while abutting against the upper surface of the sheet S, whereby the sheet S is hit against the reference wall 323 and is aligned.

The alignment of the sheet in the sheet transport direction and the cross direction of the sheet becomes possible by these operations. In order to keep the thus aligned state, stamping means 400 for pressing the sheet S aligned by a lever 400*b* provided with a frictional member 400*a* as shown in FIGS. 7A and 7B which are views as looking along the arrow A of FIG. 3A being vertically moved is provided near the right end surface of the sheet aligned as shown in FIGS. 6A and 6B.

Figure 7A:
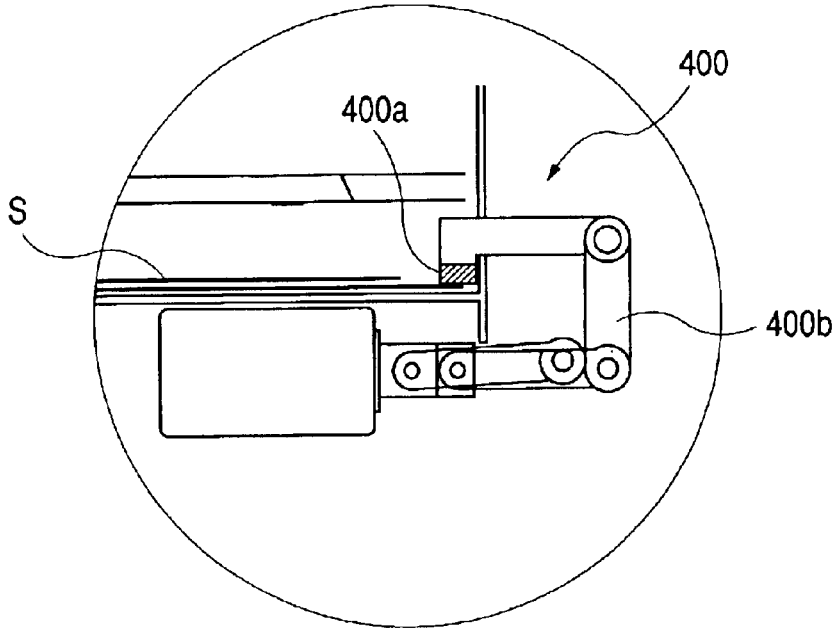
FIGS. 7A and 7B are views as looking along the arrow A of FIG. 3A.
Figure 7B:
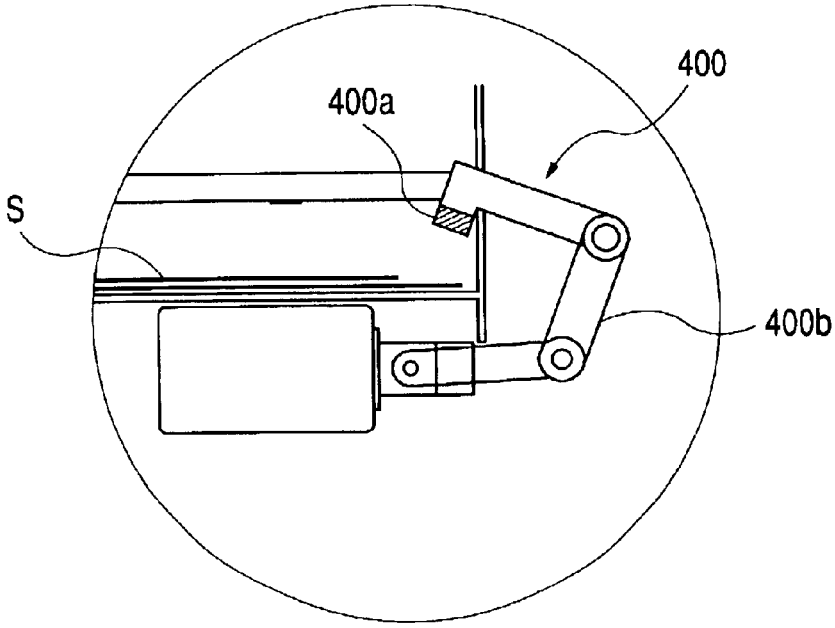

This stamping means 400 is provided with the vertically pivotally movable lever 400*b*, and after the aligning operation has been terminated and before a sheet coming in next abuts against the aligned sheet, the lever 400*b* so far upwardly pivotally moved as shown in FIG. 7B is downwardly pivotally moved, and presses the upper surface of the sheet as shown in FIG. 7A, whereby the sheet aligned by the next sheet is moved so as to prevent the alignment from being disturbed.

After the alignment of the first sheet is terminated in this manner, the second sheet is transported, and in this case, during the transport of the second and subsequent sheets, the pair of delivery rollers 330 are in a second state in which they are spaced apart from each other and therefore, when the trailing end of the sheet S completely passes between the pair of staple rollers 320, the sheet is returned in a direction opposite to the transport direction with the aid of gravity, and is moved toward the reference wall 323. The aligning operation after this is entirely similar to that for the first sheet and therefore need not be described.

Such an operation is repetitively performed and the operation of aligning the last (n-th) sheet (Sn) in one job is performed, and each reference pin 304 provided on the slide guide 302 hits against the left side of the sheet against each reference pin 303 of the slide guide 301, and in the state of FIGS. 6A and 6B in which the movement of the slide guide 302 is stopped, the right position of the trailing end is stapled by a small stapler H located on the right side of the trailing end of the sheet bundle.

According to such construction and operation, during the aligning operation for each sheet, the slide guide 301 is stopped at a reference position and is not moved, but only the slide guide 302 is moved and the left end portions of the sheets are aligned at the reference position and therefore, the stitching treatment by the stapler H fixedly disposed on the slide guide 301 side is effected accurately and reliably.

Further, even when the widths of sheets transported in at one job are uneven or when the sheet size varies from e.g. LTR to A4 in one job, the positions of the left end portions of the sheets are aligned constantly and therefore, the finish of the stitching treatment by the stapler H becomes accurate and neat, and an excellent effect can be obtained.

Figure 5C:
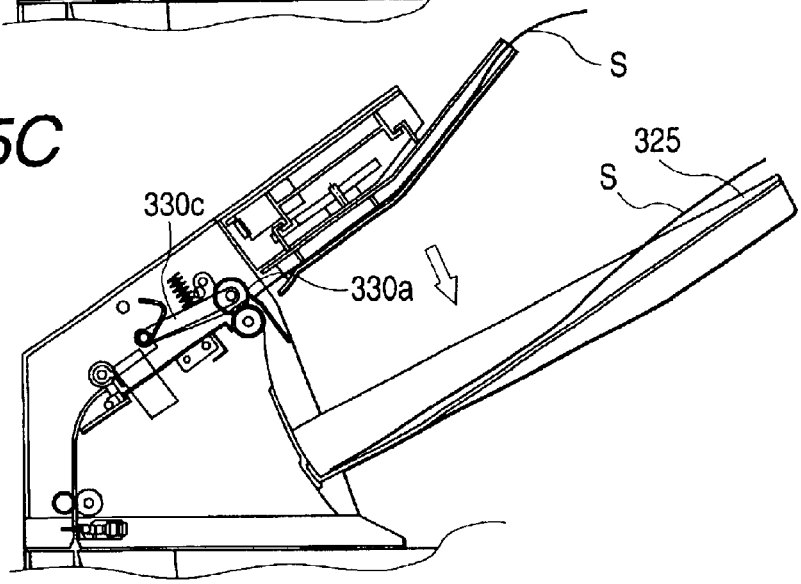

On the other hand, when the stapling operation is terminated in this manner, as shown in FIG. 5C, the arm 330*c* is clockwisely rotated, whereby the upper delivery roller 330*a* supported by the arm 330*c* is downwardly moved and the pair of delivery rollers 330 assume a first state in which they can deliver the sheet and at the same time, the pair of delivery rollers 330 are driven to thereby start the rotation of the upper delivery roller 330*a* and the lower delivery roller 330*b*. Thereby, the sheet bundle S is nipped between the pair of delivery rollers 330 and is transported onto the first stacking portion 300B formed by the slide guides 301 and 302.

Thereafter, the sheet bundle S is completely delivered from the pair of delivery rollers 330, whereupon the jogger motor M is driven to rotate, whereby the slide guide 302 is moved in a direction to widen from the state shown in FIGS. 6A and 6B. At the start of this movement of the slide guide 302, on the slide guide 301 side, the slide rack 312 is moved to right as viewed in FIGS. 6A and 6B and the slide guide 301 itself is not immediately moved.

When the position of the slide guide 302 passes the standby position shown in FIGS. 3A and 3B, the embossed portion 312*a* of the slide rack 312 abuts against the end surface of the rectangular aperture portion 310*a* of the slide guide 301, and the slide guide 301 starts to be moved to right as viewed in FIGS. 3A and 3B, and the two slide guides 301 and 302 are moved.

Further, thereafter, when the spacing between the slide guides 301 and 302 becomes approximate to or wider than the width of the sheet, the stapled sheet bundle being supported by the slide guides 301 and 302 falls downwardly as shown in FIG. 5C, and is stacked on the second stacking portion 325. What have been described above are the construction and a series of operations of the main body of the printer and the sheet treating apparatus according to the present embodiment.

Now, as already described, in the present embodiment, design is made such that the sheet treating apparatus 300 is mounted on the upper portion of the main body 100 of the printer, and the transport path of the sheets delivered from the main body 100 of the printer is changed over by the flapper 150, whereby the sheets can be inverted and delivered and stacked.

As described above, design is made such that the sheet treating apparatus 300 is mounted on the upper portion of the main body 100 of the printer and the sheets are inverted and delivered and stacked, whereby without a switchback mechanism being provided, sheets on which images have been formed can be delivered and stacked in the order of pages. Also, there is not the inconvenience that the spacing between sheets must be made wide for the purpose of switchback.

As described above, in the main body 100 of such a printer (image forming apparatus) that sheets are delivered to the upper surface of the apparatus, the sheet treating apparatus 300 is provided above the delivery portion on the upper surface of the main body of the apparatus so that after treatment is effected with a sheet inverted or on an inverted sheet, the operation of delivering the sheet to the second stacking portion 325 may be selectively performed, whereby the construction of the sheet treating apparatus 300 can be simplified and also, the installation areas and costs of the sheet treating apparatus 300 and the main body 100 of the printer (image forming apparatus) having the same can be reduced.

Further, design is made such that when the sheet is to be treated, the sheet delivered from the pair of delivery rollers 330 is supported by the slide guides 301 and 302, whereafter the sheet after treated is delivered to the second stacking portion 325, and on the other hand, when the treatment for the sheet is not effected, the sheet delivered from the pair of delivery rollers 330 is directly delivered to the second stacking portion 325 and therefore, it becomes unnecessary to discretely provide a transport path for sheets on which treatment is not effected and thus, the installation areas and costs of the sheet treating apparatus 300 and the main body 100 of the printer (image forming apparatus) having the same can be reduced.

Further, when the sheets are to be stitched as in the present embodiment, the pair of delivery rollers 330 are spaced apart from each other, whereby there can be formed the first stacking portion 300B constituted by the slide guides 301 and 302, and the sheet aligning and stacking portion 300E (see FIG. 5B) for aligning the sheet S on the sheet transport path R1 between the reference wall 323 and the pair of delivery rollers 330. Thereby, it becomes possible to effect the alignment of the sheet bundle without always providing a dedicated aligning portion, and the simplification, downsizing and lower cost of the sheet treating apparatus 300 can be realized.

While in the description hitherto made, there has been described a construction in which during the sheet aligning operation, only the slide guide 302 is operated and the slide guide 301 is not operated, there may be adopted a construction in which during the sheet aligning operation, the slide guide 301 is also operated. In such case, the purpose can be realized, for example, by making the slide guide 301 similar in construction to the slide guide 302.

Further, while there has been shown a construction in which when the sheet after the aligning operation is to be dropped downwardly, the two slide guides 301 and 302 are operated, there may be adopted a construction in which when the sheet S is to be dropped downwardly, only one of the slide guides 301 and 302 is operated.

Also, while description has hitherto been made of a case where the stitching treatment is effected as the treatment for the sheets, according to this construction, it is also possible to obtain a similar effect by a sheet treating apparatus for effecting such treatment as makes a sheet bundle by a puncher for punching the sheets or by pasting the sheets.

A second embodiment of the present invention will now be described.

Figure 8:
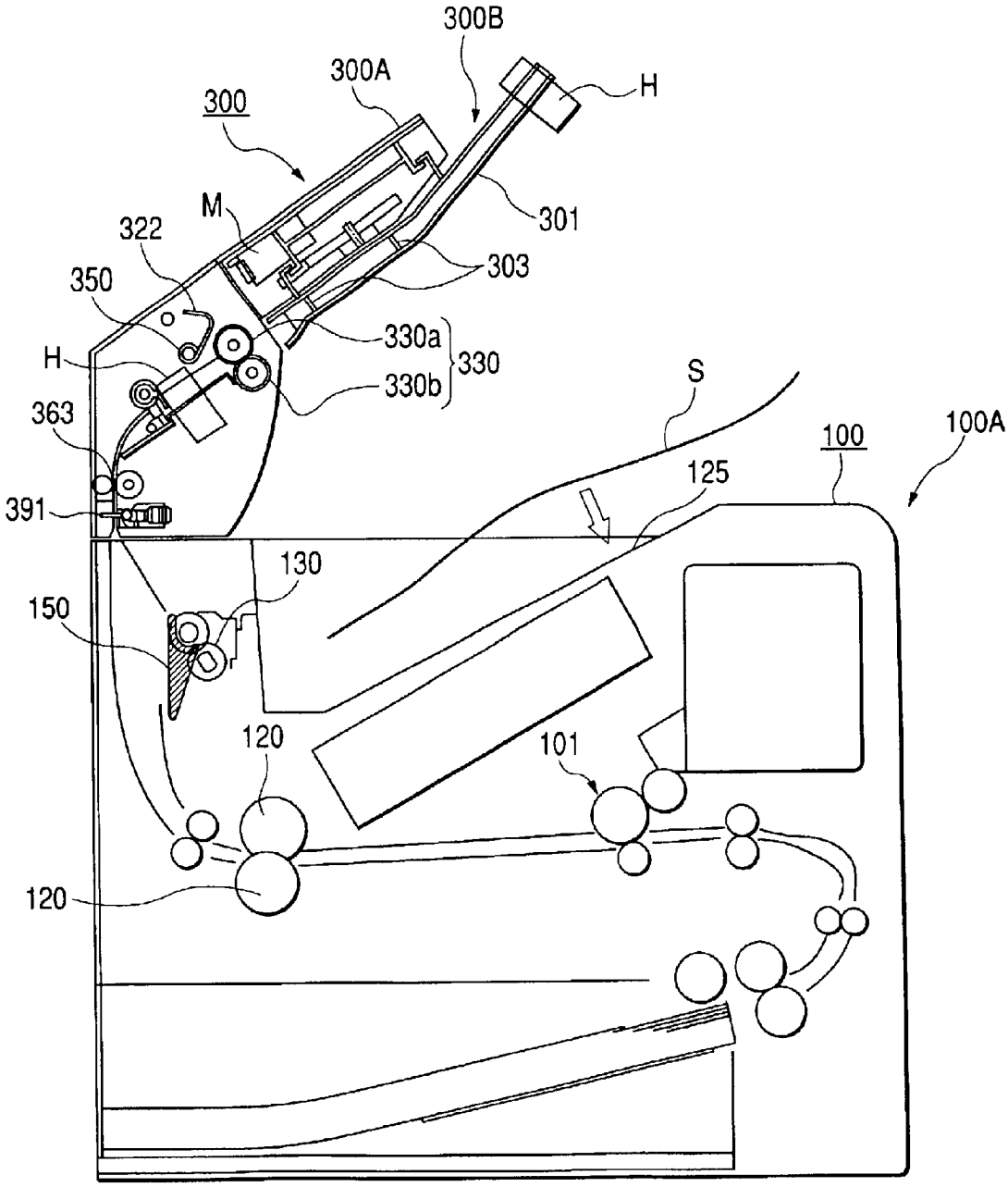
FIG. 8 is a schematic cross-sectional view showing the general construction of a laser beam printer which is an example of an image forming apparatus having a sheet treating apparatus according to a second embodiment of the present invention.

FIG. 8 is a schematic cross-sectional view showing the general construction of a laser beam printer which is an example of an image forming apparatus having a sheet treating apparatus according to the present embodiment. In FIG. 8, the same reference characters as those in FIG. 1 designate the same or corresponding portions.

In the present embodiment, as shown in FIG. 8, a second stacking portion for stacking thereon sheets delivered from the sheet treating apparatus 300 and a sheet bundle after the stapling treatment is used as a face-down (FD) delivery portion 125 provided on the upper surface of the main body 100 of the printer.

When the sheets are to be simply stacked without being staple-treated, the slide guides 301 and 302 are brought into their retracted positions in advance, whereby the sheets are directly stacked on the face-down (FD) delivery portion 125 of the main body 100 of the printer by the pair of delivery rollers 330. The staple-treated sheet bundle is also stacked on the face-down (FD) delivery portion 125.

By design being thus made such that the inverted sheet or the staple-treated sheet bundle is stacked from the sheet treating apparatus 300 onto the face-down (FD) delivery portion 125 of the main body 100 of the printer, such second stacking portion 325 as in the first embodiment already described becomes unnecessary. Thereby, the simplification and lower cost of the sheet treating apparatus 300 can be realized.

In the present embodiment, the pair of delivery rollers 330 are made incapable of being spaced apart from each other. When the pair of delivery rollers 330 are thus made incapable of being spaced apart from each other, in order to secure an area for supporting the sheet, it is necessary to extend the slide guides 301 and 302 in the delivery direction, but it is possible to keep the pair of delivery rollers 330 in their nipping state and therefore, the construction can be simplified. In the present embodiment, the stapler H is provided on the leading end of the sheet.

Figure 9:
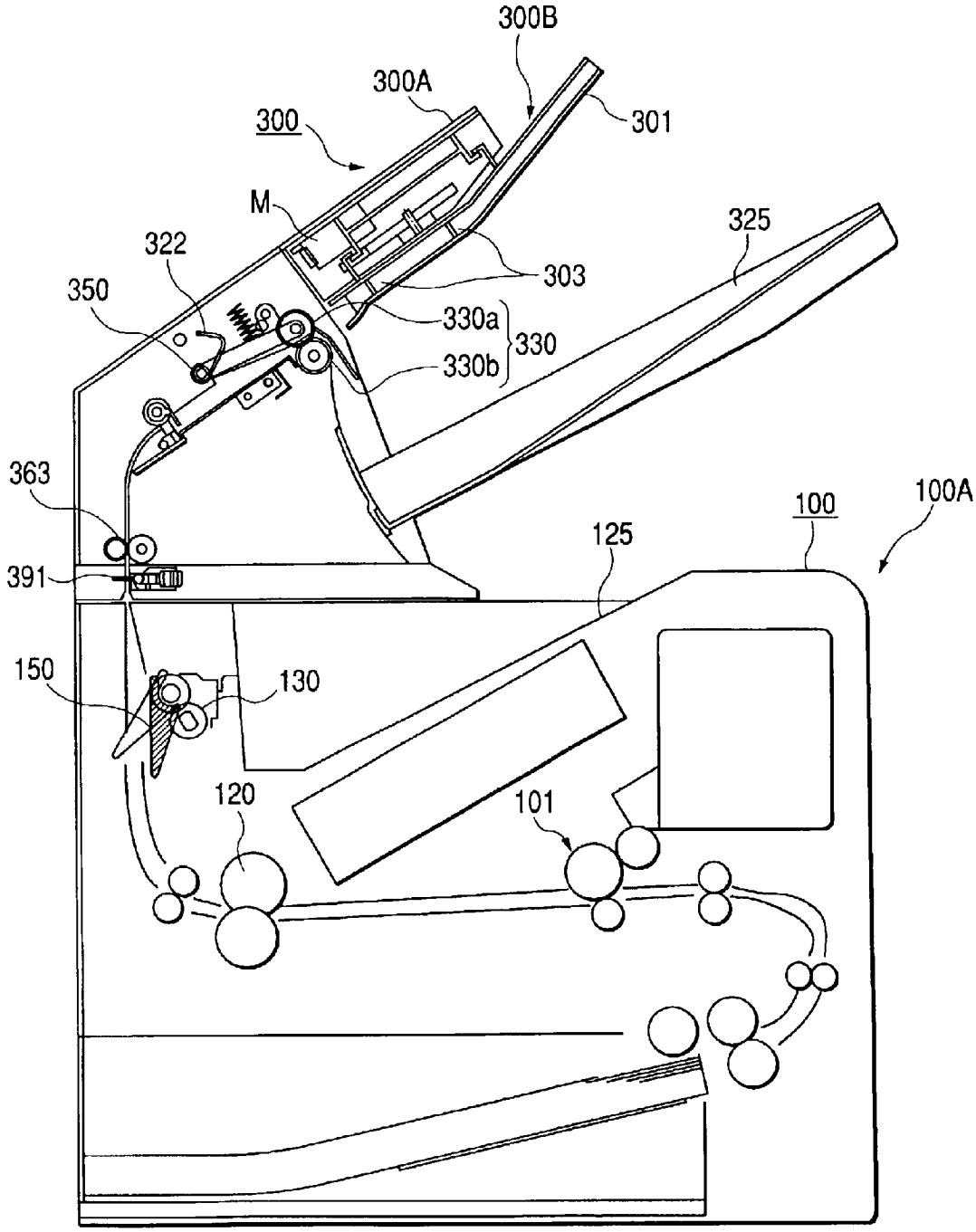
FIG. 9 is a schematic cross-sectional view showing the general construction of a laser beam printer which is an example of an image forming apparatus having a sheet treating apparatus according to a third embodiment of the present invention.

Now, while in the description hitherto made, an apparatus which effects the stapling treatment as the treatment for the sheets has been described as an example of the sheet treating apparatus 300, the present invention is not restricted thereto, but can also applied to an apparatus which, as shown, for example, in FIG. 9, is not provided with the stapler H, but effects only the alignment of sheets as the treatment for the sheets.

In the case of such a sheet treating apparatus according to a third embodiment of the present invention, the slide guides 301 and 302 are used only to offset the job.

Description will now be made of the sheet aligning operation of such a sheet treating apparatus according to the present embodiment.

When for example, at the step before the stapling operation in the aforedescribed first embodiment, the aligning operation for one or more sheets in the cross direction and the sheet transport direction is terminated, as shown in FIG. 5C already described, the pair of delivery rollers 330 are formed and at the same, drive is connected to both of the pair of delivery rollers 330 to thereby start the rotation of the upper delivery roller 330*a* and the lower delivery roller 330*b*. Thereby, the sheet bundle S is nipped between the pair of delivery rollers 330 and is transported onto the first stacking portion 300B formed by the slide guides 301 and 302.

Thereafter, the sheet bundle S is completely delivered from the pair of delivery rollers 330, whereupon the jogger motor M is driven to rotate, whereby the slide guide 302 is moved in a direction to widen from the state shown in FIGS. 6A and 6B. At the start of this movement of the slide guide 302, the slide rack 312 of the slide guide 301 side is moved to right as viewed in FIGS. 6A and 6B and the slide guide 301 itself is not immediately moved.

When the position of the slide guide 302 passes the standby position shown in FIGS. 3A and 3B, the embossed portion 312*a* of the slide rack 312 abuts against the end surface of the rectangular aperture portion 310*a* of the slide guide 301, whereby the slide guide 301 starts to be moved to right as viewed in FIGS. 3A and 3B, and the two slide guides 301 and 302 are moved.

Further, when thereafter the spacing between the two slide guides 301 and 302 becomes approximate to or wider than the width of the sheet, the stapled sheet bundle supported by the slide guides 301 and 302 falls downwardly as shown in FIG. 5C already described, and is stacked on the second stacking portion 325.

As described above, according to the present embodiment, the sheet aligned by the slide guides 301 and 302, as compared with the sheet in the first embodiment delivered without being aligned by the slide guides 301 and 302, can be provided with a difference in position in the cross direction of the sheet.

A fourth embodiment of the present invention will now be described.

Figure 10:
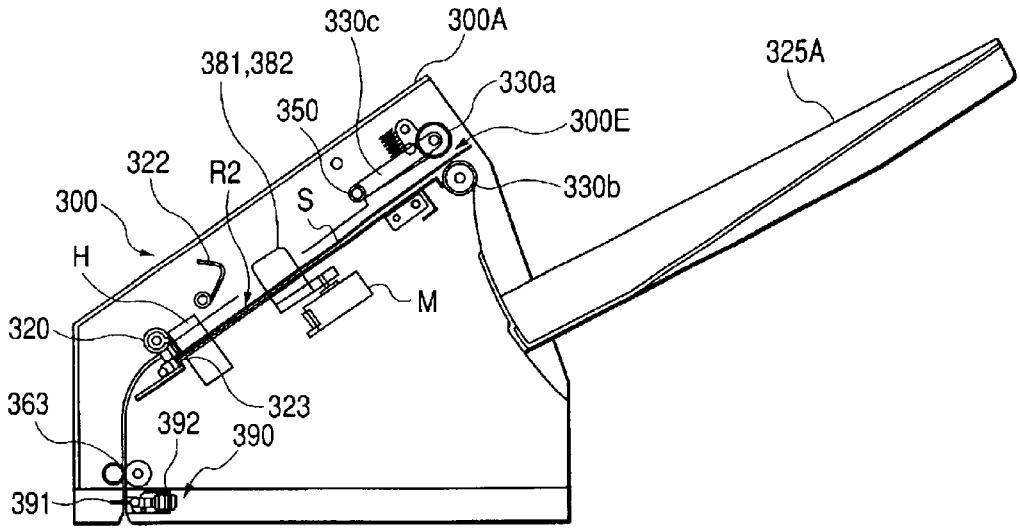
FIG. 10 shows the construction of a sheet treating apparatus according to a fourth embodiment of the present invention.

FIG. 10 is a schematic cross-sectional view showing the construction of a sheet treating apparatus according to the present embodiment. In FIG. 10, the same reference characters as those in FIG. 1 designate the same or corresponding portions.

In the present embodiment, instead of the slide guides 301 and 302 provided downstream of the pair of delivery rollers 330 in the aforedescribed first embodiment, a pair of joggers 381 and 382 as aligning means are provided upstream of the pair of delivery rollers 330, as shown in FIG. 10.

Also, in the aforedescribed first embodiment, the sheet aligning and stacking portion is constituted by the first stacking portion 300B comprised of the slide guides 301 and 302 and the sheet transport path between the reference wall 323 (the pair of staple rollers 320) and the pair of delivery rollers 330, but in the present embodiment, the distance of the sheet transport path R2 between the reference wall 323 (the pair of staple rollers 320) and the pair of delivery rollers 330 is made long, whereby a sheet aligning and stacking portion 300E is formed between the reference wall 323 and the pair of delivery rollers 330.

By the sheet aligning and stacking portion 300E being thus formed between the reference wall 323 and the pair of delivery rollers 330, the sheet aligning and stacking portion 300E can be contained in the casing portion 300A of the sheet treating apparatus 300. Thus, it never happens that a user or the like touches a sheet being treated, and the treatment of the sheet can be effected more reliably.

Description will now be made of the sheet treating (stitching) operation according to the present embodiment constructed as described above. The operation of delivering and stacking the sheet on the sheet stacking portion 325A in the face-down state is similar to that in the first embodiment and therefore need not be described here, but description will be made of the operation of stapling the sheets and delivering and stacking them on the sheet stacking portion 325A.

In this case, the arm 330*c* is counter-clockwisely pivotally moved, whereby the upper delivery roller 330*a* is upwardly retracted and the pair of delivery rollers 330 are spaced apart from each other and at the same time, the drive connected to the pair of delivery rollers 330 is cut off to thereby stop the rotation of the upper delivery roller 330*a* and the lower delivery roller 330*b*. By this operation, the sheet aligning and stacking portion 300E for aligning the sheet S is formed in the sheet transport path R2 between the reference wall 323 (the pair of staple rollers 320) and the pair of delivery rollers 330.

Next, the sheet S transported into the sheet treating apparatus 300 clockwisely rotates the flag 391 of the entrance sensor 390, whereby the flag 391 makes the photosensor 392 transmit light therethrough, whereby the sheet S is detected. Thereafter, the sheet S is upwardly transported by a pair of entrance rollers 363.

Next, when the trailing end of the sheet S completely passes between the pair of staple rollers 320, the sheet S is returned in a direction opposite to the transport direction with the aid of gravity, and is moved toward the reference wall 323. Thereafter, as shown in FIG. 11, of the pair of joggers 381 and 382, the left jogger 382 is operated, and the operation of aligning the sheets S in the cross direction of the sheets stacked on the sheet transport path between at least the pair of staple rollers 320 and the pair of delivery rollers 330 is started.

Figure 11:
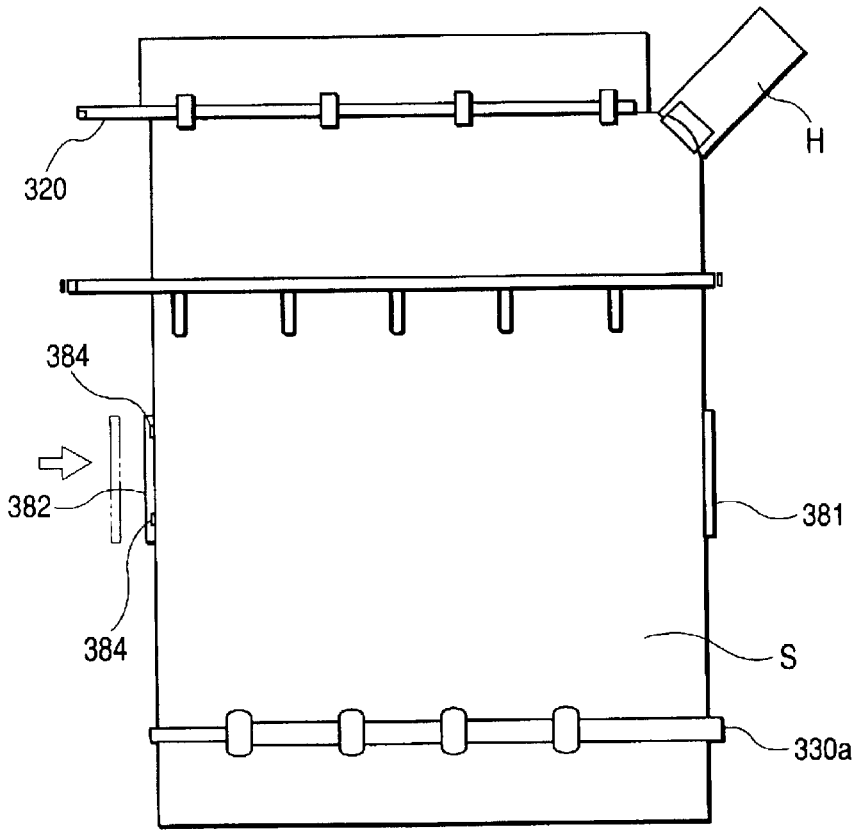
FIG. 11 is a plan view of the essential portions of the sheet treating apparatus.

Specifically, the left jogger 382 is driven by the motor M (see FIG. 10) and is moved toward the sheet in the direction indicated by the arrow in FIG. 11, whereby each reference pin 384 provided on the jogger 382 abuts against the left side of the sheet S and pushes the sheet S toward the right jogger 381, whereby the side of the sheet S hits against the right jogger 381, whereby the alignment of the sheet S is effected in the cross direction of the sheet.

Design is made such that when the sheet S thus abuts against the right jogger 381 and assumes its aligned position, the sheet S is located at a preset staple position.

After such aligning operation, the left jogger 382 is moved in a direction to become wider than the width of the sheet S, which direction is opposite to the direction indicated by the arrow so that the transport of the next sheet can be again coped with at the standby position.

After the alignment of the first sheet has been terminated in this manner, the second sheet is transported, but in this case, during the transport of the second and subsequent sheets, the pair of delivery rollers 330 are in a second state in which they are spaced apart from each other and therefore, when the trailing edge of the sheet S completely passes between the pair of staple rollers 320, the sheet is returned in the direction opposite to the transport direction with the aid of gravity, and is moved toward the reference wall 323. The aligning operation thereafter is entirely similar to that for the first sheet and therefore need not be described.

Such operation is repetitively performed to thereby perform the operation of aligning the last (n-th) sheet (Sn) in one job, whereafter the movement of the jogger 382 is stopped in a state in which the jogger 382 has hit the sheet S against a jogger 381, and in this state, the right position of the trailing end of the sheet bundle is stapled by the stapler H located at the right of the trailing end of the sheet bundle.

Figure 12:
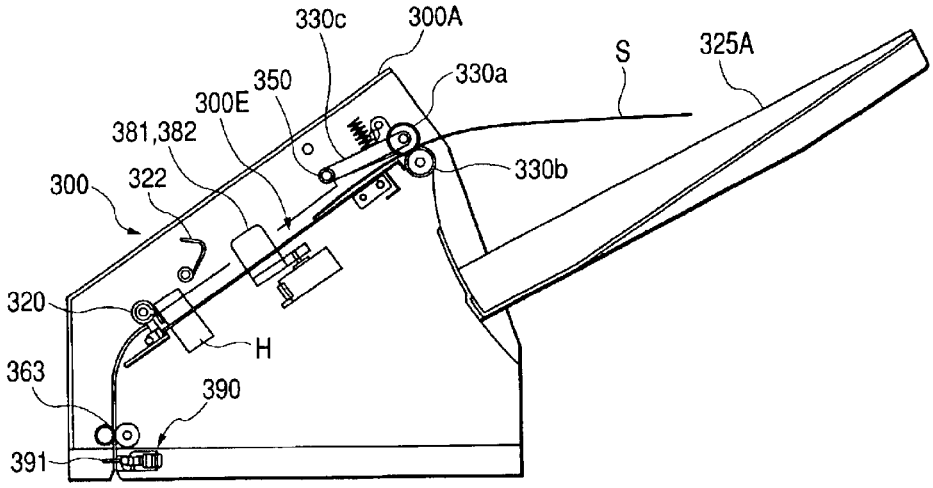
FIG. 12 shows the operation of delivering sheets stapled by the sheet treating apparatus.

On the other hand, when the stapling operation is terminated in this manner, as shown in FIG. 12, the arm 330*c* is clockwisely rotated, whereby the upper delivery roller 330*a* supported by the arm 330*c* is downwardly moved and the pair of delivery rollers 330 assume a first state in which they can deliver the sheet and at the same time, the pair of delivery rollers 330 are driven to thereby start the rotation of the upper delivery roller 330*a* and the lower delivery roller 330*b*. Thereby, the stapled sheet (bundle) S is transported to and stacked on the sheet stacking portion 325A of the sheet treating apparatus 300.

As in the present embodiment, design is thus made such that when the pair of delivery rollers 330 are in the second state, the sheet aligning and stacking portion 300E is formed, whereby it becomes possible to effect the alignment of the sheet bundle without providing a dedicated aligning portion at all times, and the simplification, downsizing and lower cost of the sheet treating apparatus 300 can be realized.

Also, by the joggers 381 and 382 (aligning means) being provided upstream of the pair of delivery rollers 330, the upper portion of the sheet stacking portion 325A can be opened and thus, the sheets S stacked on the sheet stacking portion 325A can be easily taken out.

A fifth embodiment of the present invention will now be described.

Figure 13:
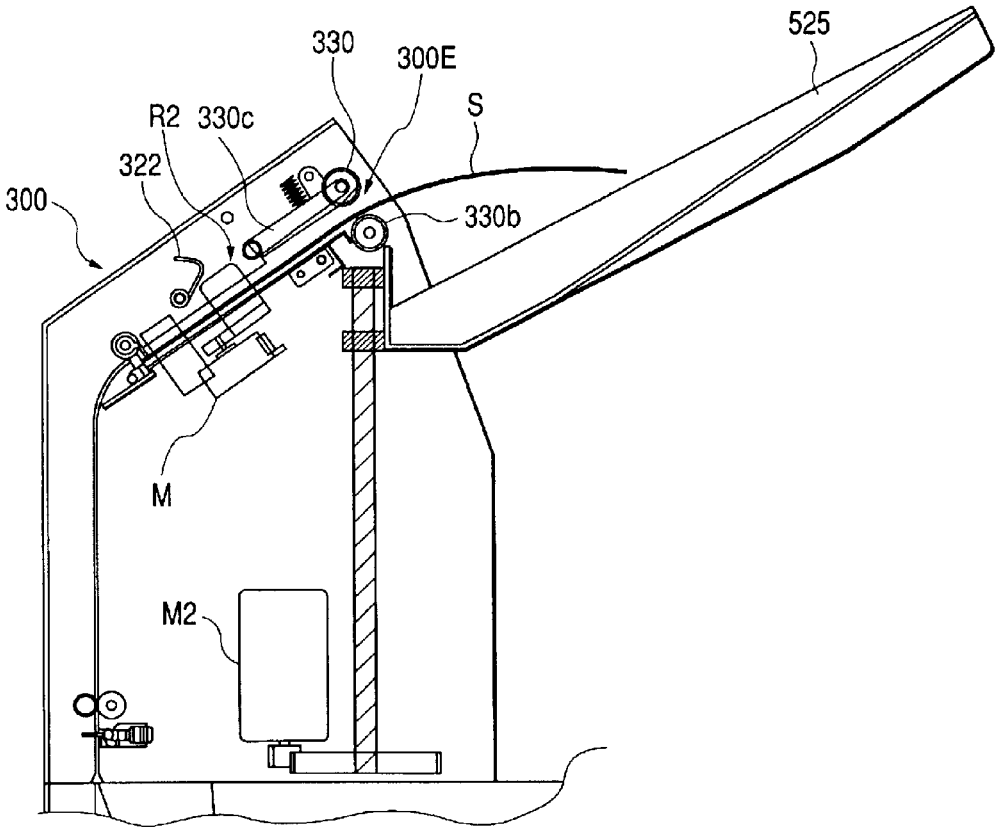
FIG. 13 shows the construction of a sheet treating apparatus according to a fifth embodiment of the present invention.

FIG. 13 is a schematic cross-sectional view showing the construction of a sheet treating apparatus according to the present embodiment. In FIG. 13, the same reference characters as those in FIG. 10 designate the same or corresponding portions.

In FIG. 13, the reference numeral 525 designates a tray constituting a sheet stacking portion, and in the present embodiment, this tray 525 is movable up and down by a motor M2. By the tray 525 being thus made movable up and down, it becomes possible to support the leading end portion of the sheet S by the tray 525 as shown in FIG. 13 when the sheet S is aligned and stapled.

Thus, when as shown in FIG. 13, the pair of delivery rollers 330 assumes the second state, the sheet aligning and stacking portion 300E can be formed by the sheet transport path R2 between the reference wall 323 (the pair of staple rollers 320) and the pair of delivery rollers 330 and the tray 525.

Figure 14:
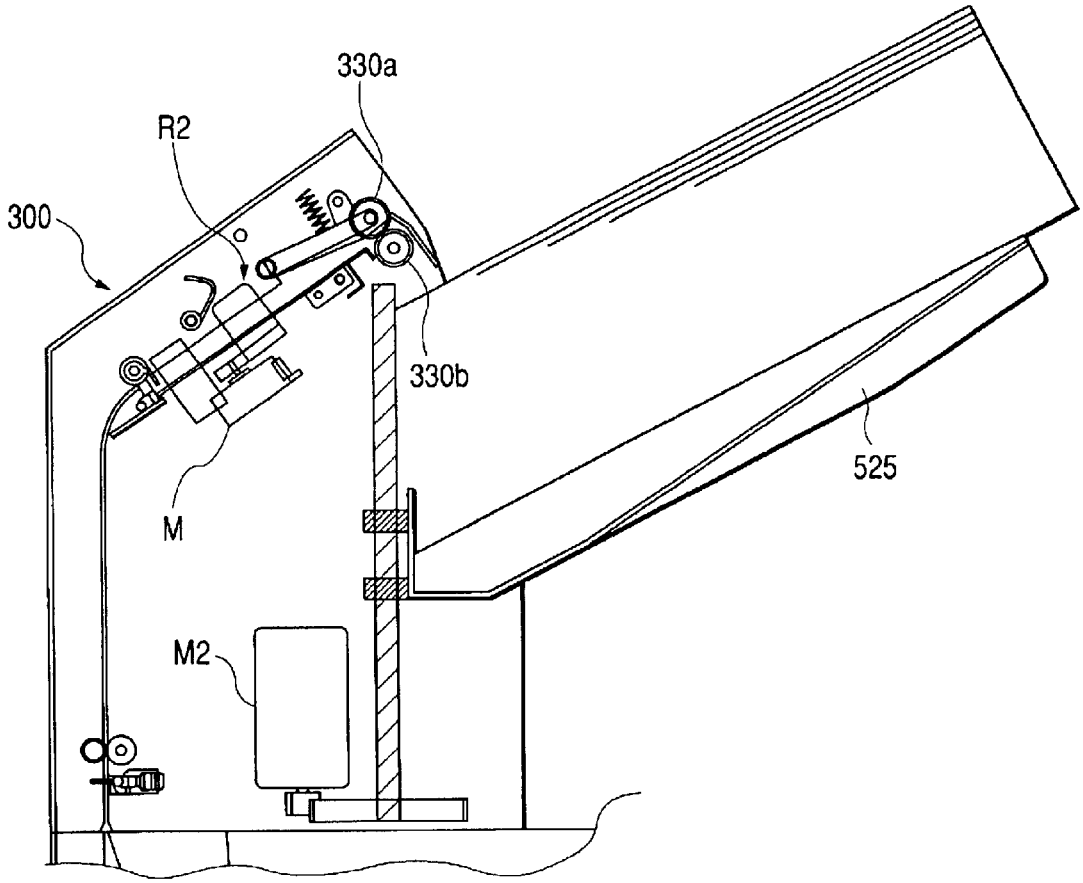
FIG. 14 shows a state in which a tray provided in the sheet treating apparatus has been lowered in conformity with the number of stacked sheets thereon.

By the sheet aligning and stacking portion 300E being thus formed by the sheet transport path R2 and the tray 525, the length of the sheet transport path R2 can be shortened. Also, the portion above the tray 525 can be opened and therefore, the sheets S stacked on the tray 525 can be easily taken out. Also, as shown in FIG. 14, the tray 525 is lowered in conformity with the number of stacked sheets thereon, whereby the number of sheets stacked thereon can be made great.

What is claimed is:

1. A sheet treating apparatus for effecting treatment on a sheet, comprising:

a transport rotary member, which transports a sheet;

a first sheet stacking portions, which temporarily stacks the sheet transported by said transport rotary member, said first sheet stacking portion dropping the sheet after the treatment is effected on the sheet;

a pair of delivery rotary members, disposed downstream of said transport rotary member, which deliver the sheet transported by said transport rotary member; and a second sheet stacking portion positioned substantially vertically under said first sheet stacking portion, which supports a sheet directly delivered by said pair of delivery rotary members or a sheet dropped after the treatment in said first sheet stacking portion is completed, wherein said first sheet stacking portion comprises a sheet transport path between said transport rotary member and said pair of delivery rotary members, and a sheet supporting portion provided downstream of said pair of delivery rotary members and movable between a sheet stacking position and a retreat position, wherein said pair of delivery rotary members is movable between a first position in which said pair of delivery rotary members delivers the sheet and a second position in which rotary members of said of delivery rotary members are separated from each other, wherein when said pair of delivery rotary members is in the first position and when said sheet supporting portion is in the retreat position, the sheet is directly stacked on said second sheet stacking portion, and wherein when said pair of delivery rotary members is in the second position and when the sheet supporting portion is in the sheet stacking position, the treatment is effected on the sheet.

2. A sheet treating apparatus according to claim 1, wherein after the treatment on the stacked sheet is completed, said sheet supporting portion is moved to the retreat position, and said pair of delivery rotary members is moved to the first position for delivering the treated sheet onto said second sheet stacking portion.

3. A sheet treating apparatus according to claim 1, wherein said first sheet stacking portion is formed by supporting members of said sheet supporting portion disposed opposite to each other, wherein when said first sheet stacking portion is in the sheet stacking position, a spacing between said supporting members becomes narrower than a width of the sheet transported from said transport rotary member to stack the sheet on said first sheet stacking portion, and wherein when said first sheet stacking portion is in the retreat position, the spacing between said supporting members is wider than the width of the sheet.

4. A sheet treating apparatus according to claim 1, further comprising aligning members, provided downstream of said pair of delivery rotary members in opposed relationship with each other, which abut against widthwise sides of the sheet stacked on said first sheet stacking portion to regulate a position of the sheet.

5. A sheet treating apparatus according to claim 4, wherein said aligning members are provided integrally with said sheet supporting portion.

6. A sheet treating apparatus according to claim 5, wherein said sheet supporting portion comprises support surfaces, constituting said first sheet stacking portion, which support the sheet transported by said transport rotary member, and abutment surfaces, provided respectively on ends of said support surfaces, which abut against the widthwise sides of the sheet to align the sheet.

7. A sheet treating apparatus according to claim 4, wherein the treatment to be effected on the sheet is an alignment operation with respect to the sheet stacked on said first sheet stacking portion.

8. A sheet treating apparatus according to claim 4, wherein said aligning members each includes a plurality of convex portions which abut against the widthwise sides of the sheet to align the sheet at a predetermined position.

9. A sheet treating apparatus according to claim 8, wherein said plurality of convex portions are formed of a material having high abrasion resistance.

10. A sheet treating apparatus according to claim 1, wherein when said pair of delivery rotary members is moved to the second position, a drive of said pair of delivery rotary members is disconnected.

11. A sheet treating apparatus according to claim 1, wherein said second sheet stacking portion is disposed on an upper portion of an image forming apparatus, which forms an image on the sheet to be treated.

12. A sheet treating apparatus according to claim 1, further comprising a sheet returning member, which aligns the sheet stacked on said first sheet stacking portion in a sheet transport direction, and a wall member, disposed in a vicinity of said transport rotary member, which aligns a trailing end of the sheet returned by said sheet returning member.

13. A sheet treating apparatus according to claim 1, further comprising a stapler, which staples sheets stacked on said first sheet stacking portion at a predetermined position of the stacked sheets.

14. A sheet treating apparatus according to claim 13, wherein the treatment to be effected on the sheet is a stapling operation with respect to the stacked sheets.

15. An image forming apparatus comprising:

an image forming portion; and a sheet treating apparatus as recited in claim 1, for effecting treatment on a sheet on which an image is formed by said image forming portion.

* * * * *

UNITED STATES PATENT AND TRADEMARK OFFICE

CERTIFICATE OF CORRECTION

PATENT NO. : 6,942,206 B2
APPLICATION NO. : 10/227482
DATED : September 13, 2005
INVENTOR(S) : Takashi Kuwata et al.

It is certified that error appears in the above-identified patent and that said Letters Patent is hereby corrected as shown below:

COLUMN 1:

Line 22, “one a” should read --one of a--.

COLUMN 3:

Line 27, “treated” should read --treatment--; and
Line 36, “assume” should read --assumes--.

COLUMN 11:

Line 11, “treated” should read --treatment--.

COLUMN 12:

Line 30, “also applied” should read --also be applied--.

COLUMN 14:

Line 44, “assume” should read --assumes--.

COLUMN 15:

Line 29, “portions,” should read --portion,--;
Line 34, “deliver” should read --delivers--; and
Line 52, “said of” should read --said pair of--.

UNITED STATES PATENT AND TRADEMARK OFFICE

CERTIFICATE OF CORRECTION

PATENT NO. : 6,942,206 B2
APPLICATION NO. : 10/227482
DATED : September 13, 2005
INVENTOR(S) : Takashi Kuwata et al.

It is certified that error appears in the above-identified patent and that said Letters Patent is hereby corrected as shown below:

COLUMN 16:

Line 34, “includes” should read --include--.

Signed and Sealed this

Twenty-ninth Day of August, 2006

JON W. DUDAS
*Director of the United States Patent and Trademark Office*